United States Patent [19]

Kotasek et al.

[11] Patent Number: 4,756,246

[45] Date of Patent: Jul. 12, 1988

[54] LUBRICATION SYSTEM FOR PRINT HAMMER PIVOT PIN

[75] Inventors: Thomas J. Kotasek; Ho C. Lee, both of Endicott; Joseph Pinter, Apalachin; Alex T. Shalkey, Vestal, all of N.Y.

[73] Assignee: International Business Machines Corporation, Armonk, N.Y.

[21] Appl. No.: 107,302

[22] Filed: Oct. 13, 1987

[51] Int. Cl.[4] ..... B41J 9/38

[52] U.S. Cl. ..... 101/93.48; 101/93.29; 400/157.2

[58] Field of Search ..... 101/93.28, 93.29, 93.30, 101/93.31, 93.32, 93.33, 93.34, 93.35, 93.36, 93.48; 400/155, 157.1, 157.2, 157.3, 157.4

[56] References Cited

U.S. PATENT DOCUMENTS

| | | | |
|---|---|---|---|
| 3,138,412 | 6/1964 | Dole | 310/90 |
| 4,269,117 | 5/1981 | Lee et al. | 101/93.48 X |
| 4,290,655 | 9/1981 | Apuzzo et al. | 384/286 |
| 4,430,936 | 2/1984 | Adanioli et al. | 101/93.48 |
| 4,699,051 | 10/1987 | Jezbera | 101/93.34 |

*Primary Examiner*—Charles Pearson

*Attorney, Agent, or Firm*—John S. Gasper; Douglas M. Clarkson

[57] ABSTRACT

The disclosure describes in detail one of the most serious problems in connection with maintaining the operating life of print hammers at the high speeds of todays printers. Also described in detail is a structural arrangement to solve this problem without involving a major redesign of a print hammer module. A significant aspect of this solution is that a high speed print hammer is kept out of contact with structure that serves as a reservoir for the pivot pin lubricant.

16 Claims, 3 Drawing Sheets

LUBRICATION SYSTEM FOR PRINT HAMMER PIVOT PIN

BACKGROUND OF THE INVENTION

1. Field of the Invention

The present invention, generally, relates to print hammer devices for use in high speed printing apparatus and, more particularly, to a new and improved system for lubricating the pivot pin for such print hammer devices.

Although movement of a print hammer of the type with which the present invention is adapted to function is limited to a degree or so, the prior art of bearings for rotatable motors, generators and the like, reveal structure that is helpful in developing an understanding of the full scope of the invention. In addition, this prior art is useful to illustrate the problems solved by the invention.

2. Description of the Prior Art

There are bearing assemblies taught in the prior art that have a lubricant reservoir for holding a reserve supply of a lubricant in various forms, such as felt pads or washers. The use of felt pads or washers positioned to engage a bearing to release the lubricant by capillary action requires a mechanically rigid enclosure to hold the felt in position.

Prior U.S. Pat. No. 3,138,412 teaches the use of a lubricant absorbent ceramic as an effective self-supporting reservoir, to overcome the need for a rigid enclosure. The outer surface of the ceramic material is coated with a glaze compound to retain the lubricant and to prevent its escape. The surface of the ceramic material that is in contact with the bearing is unglazed so that lubricant is fed by capillary action.

When pivoted mechanical elements became widely used, there were other more pressing problems that required solution first, as suggested by prior U.S. Pat. No. 3,227,250 in its teaching of a readily disconnectable pivot connection. Even its suggestion of the use of a Teflon varnish for the purpose of lubricating the pivoted element has the primary reason for such use to facilitate making the connection readily disconnectable.

A somewhat later effort to solve the problem of providing a reservoir to dispense a lubricant to a moveable bearing is revealed by a French Pat. No. 2,345,618 published Oct. 21, 1977. That prior patent teaches using a woven fabric of synthetic material impregnated with easily ruptured micro capsules in its pores to break progressively during use thereby releasing lubricant to the bearing.

More recently, U.S. Pat. No. 4,290,655 provides an improvement in sintered self lubricating bearings by forming a porous sleeve with areas having different permeability for a lubricating oil to control the free circulation of the oil within the sleeve bearing of a continuously rotating shaft.

More closely associated with the environment in which the present invention is cast is U.S. Pat. No. 4,308,794. This prior patent discloses a print hammer with an internal cavity containing felt that is impregnated with lubricating oil. The cavity is sealed except for two holes through which the oil seeps to lubricate the print hammer.

While disclosing a striker mechanism for a high speed printer, a prior U.S. Pat. No. 4,430,936 suggests using oil impregnated felt washers arranged coaxially to provide lubrication for the pivot pin of the moving element.

Primarily, however, the disclosure of this prior patent describes the use of a felt pad impregnated with oil to function as a damper element for eliminating the vibrations of a print hammer and for reducing the settling time of the striker mechanism after the printing of a character.

The following prior publications are IBM Technical Disclosure Bulletins: Vol. 19, No. 8, Page 3109, dated January, 1977; Vol. 24, No. 1A, Pages 20 and 21, dated June, 1981; Vol. 24, No. 3, Pages 1420 and 1421, dated August, 1981; and Vol. 28, No. 12, Pages 5247 and 5248, dated May, 1986.

None of these IBM Technical Disclosure Bulletins and none of the above-identified prior art patents disclose or even suggest a solution to the problem of maintaining the lubrication of a high speed print hammer pivot pin over an extended period of time for increasing its useful life even further, as that provided by the present invention.

Present day high speed printers have achieved such high speeds of operation that wear of the hammer pivot pin has become a major factor in determining the useful operating life of such printers. Repairs are difficult as is a re-lubrication program for the print hammer pivot pins due to several reasons including the small, compact size of these elements.

It has been learned that these print hammer elements, due to their high speeds of operation, develop positive and negative pressures alternately on the pivot pins, which cause them to act as small pumps, actually sucking the lubricant out of the bearing reservoir. This action results in premature failure of print hammer pivot pins at today's high cyclical speeds of operation.

The pivot pins of print hammer elements customarily are made of sintered material that is impregnated with lubricant, and actually, such pivot pins provide very economical means of lubrication without requiring additional parts and extra space in the tightly-packaged areas in low speed print hammer modules. The only problem realized with this means of lubrication at todays higher speeds is the limited life of the pivot pin, typically in the order of 150 million cycles of operation.

SUMMARY OF THE INVENTION

Accordingly, it is a principal object of the present invention to provide means for extending the operating life of a high speed print hammer.

It is a general object of the invention to provide new and improved means for lubricating the pivot pin of a print hammer to extend its operating life for high speed operations.

Another object of the invention is to provide a system for lubricating the pivot pin of a print hammer that operates at increased print rates.

Yet another object of the invention is to provide, for a print hammer pivot pin, a new and improved lubrication system that is relatively simple in construction.

Briefly, a lubrication system constructed and arranged in accordance with the principles of the invention provides a reservoir to maintain pivot pin lubricant in a manner such that it is not depleted at an excessive rate. This is accomplished by a structural arrangement that keeps the lubricant reservoir out of contact with a moving component, such as the print hammer element.

Several structural arrangements are described to perform the essential function of the invention, and other arrangements will become apparent also. However, to accomplish this function without a substantial increase in cost will not be so apparent.

The above and other objects, features and advantages of the present invention will become more readily apparent from the following detailed description of the presently preferred forms of the invention, as illustrated in the accompanying drawings.

DETAILED DESCRIPTION OF THE INVENTION

Figure 1:
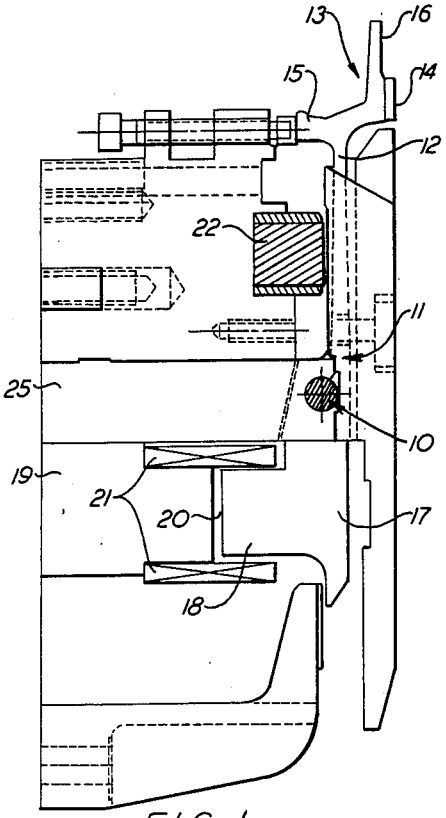
FIG. 1 (PRIOR ART)
FIG. 1 is a view of the Prior Art construction of a print hammer mechanism for use in describing the problem that is overcome by a construction in accordance with the principles of the invention.

The use of sintered pivot pins, supra, as means to retain a supply of lubricant, i.e., reservoir means, is the present day structure, and it is entirely satisfactory for low speed printers. Such a pivot pin is identified in FIG. 1 of the drawings by a reference numeral 10, and also, FIG. 1 has the legend "Prior Art".

In FIG. 1, a print hammer element is identified generally by the numeral 11, having a stem 12 and, at one end, a hammer head 13 which includes an impact face 14, a tail 15 and a tab 16 above the impact face 14 to distribute the mass of the hammer in order to have the effective center of the hammer mass coincident with the center of impact. The opposite end of the stem 12 is formed with an armature 17 having a projection 18 extending toward an electromagnet 19 forming an air gap 20.

The presence of a permanent magnet 22 on the opposite side of the pivot pin 10 from the armature 17 identifies the print hammer element as one that operates with "a snap action" and is described and claimed in U.S. Pat. No. 4,269,117 assigned to the same Assignee as the present invention. This "snap action" print hammer element has become known commercially as a "whipping hammer" and is unusually effective as a high speed print hammer.

A structure in accordance with the present invention is particularly useful with this type of high speed whipping hammer element. In the description to follow, therefore, the same reference numerals identify the same or corresponding parts in the several views.

Figure 2:
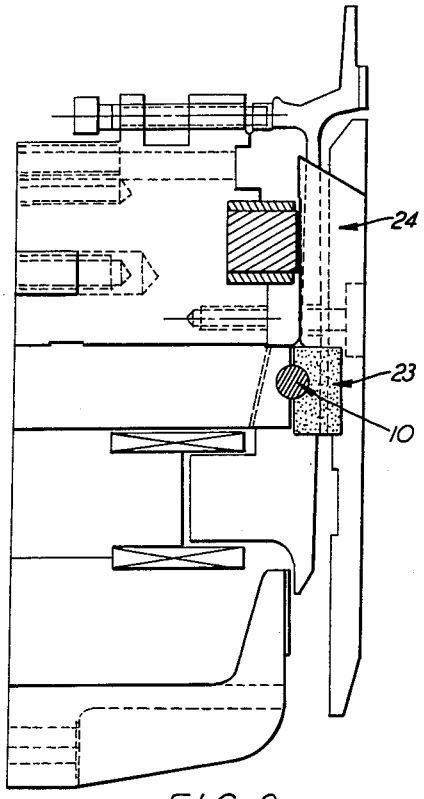
FIG. 2 is a side cross sectional view in elevation to illustrate a preferred embodiment of the invention.

FIG. 2, which illustrates a structure in accordance with the invention, shows the pivot pin 10 as being formed of a solid material, such as, for example, tungsten carbide. A sintered insert 23 is impregnated with a lubricant to function as a reservoir in keeping the pivot pin 10 lubricated, as will be explained in more detail hereinafter.

The use of sintered materials as bearings and oil reservoirs is well known, and a wide variety of materials having a wide range of porosities exist. A preferred type to be used with the configuration illustrated in FIG. 2 is made of sintered bronze having an average density of 6.4 grams per cubic centimeter. The sintered bronze is impregnated with a preferred paraffinic lubricating oil designated commercially by Mobil Oil Corporation as "DTE 797".

As has been mentioned, supra, sintered material makes an effective reservoir for moving components. The problem arises, however, when the components become moving in a particular manner, i.e., pivoting at very small angular distances such as 1, 2 or 3 degrees and, then, at a high speed.

It is in this circumstance that a print hammer element as shown in FIG. 1 acts as a pump and causes the lubricant in the sintered pivot pin 10 to overflow, becoming depleted more rapidly than at lower speeds. A lack of lubricant, of course, is the usual cause of a shortened operating life for a print hammer, but long before that occurs, an excess of lubricant interferes with normal hammer dynamics, resulting in an early failure of the print hammer through excessive flight times.

In accordance with the present invention, it has been discovered that the above-described problems are avoided by preventing a direct contact between the high speed moving print hammer and the lubricant reservoir. However, to accomplish this separation without redesigning the entire print hammer module is an important aspect of the invention.

FIG. 2 shows the sintered insert 23 in the position illustrated as requiring only a modification of a cover plate 24, referred to sometimes as a "face" plate or a "front" plate. However, it is important to note that the sintered insert 23 does not require altering the overall dimensions of a matching comb block 25, a principal part of any multiple-hammer module.

Figure 3:
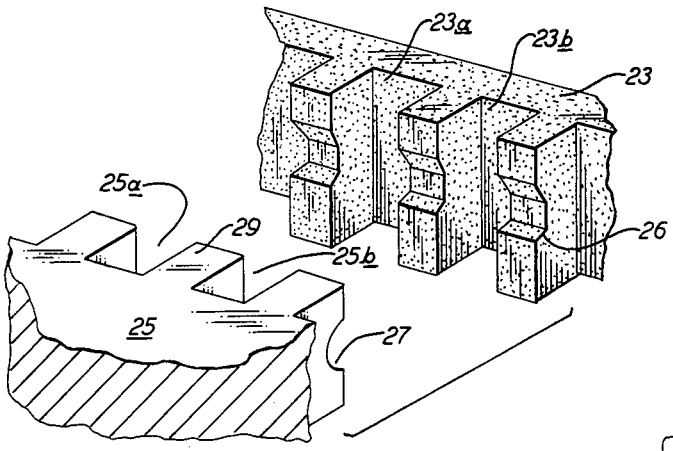
FIG. 3 is a view in perspective of a partial assembly of the structure in accordance with the invention as an aid in the description to follow.

The comb block 25 is the usual and customary construction used today in multiple-hammer modules, and as mentioned above, it does not have to be changed to accommodate the sintered insert 23 of the invention. FIG. 3 illustrates better how this comb block 25 cooperates with a sintered insert 23, constructed in accordance with the invention.

The view shown in FIG. 3 is a perspective illustration of both the sintered insert 23 and the comb block 25, showing their cooperation to accomplish an important function of the invention. However, this view also illustrates another very important aspect of the invention.

While the comb block 25 in FIG. 3 shows clearly the respective slots 25*a*, 25*b*, etc., each one of the multiple slots receives one print hammer in a close fitting position in order to control its direction of flight. However, the slots 23*a*, 23*b*, etc., in the sintered insert 23 are wider than the slots in the comb block 25, so that, due to the wider slots in the sintered insert 23, there is no contact between any print hammer and the sintered insert 23.

By the "close fitting position" mentioned above for the print hammers in the slots of the comb block 25 is meant that the fit is no closer than has been provided in the past for this fit. Therefore, there is only a secondary requirement for lubricant from the reservoir, provided by the sintered insert 23, to lubricate the sides of each print hammer. The primary need for the lubricant is for the pivot pin 10 of the print hammer 11, and it is the pivot pin 10 that is gripped tightly between a recess 26 in the sintered insert 23 and a recess 27 in the comb block 25.

Since a print hammer is only "confined" by its respective slot in the comb block 25, a principal portion of the lubricant in the reservoir, provided by the sintered insert 23, is to lubricate the print hammer pivot pin 10. The lubricating action is solely by capillary feed within the sintered insert 23, which is meniscus at the interface between the pivot pin 10 and the sintered insert 23, by a seeping action through small gaps in pivot pin/comb block/sintered insert interfaces and, finally, by the spreading characteristics of the lubricant through the surface energy difference between the lubricant and the surface of the pivot pin.

It is apparent from the above description that additional benefits will be realized from any construction that prôvides more storage capacity for the reservoir, i.e., for the sintered insert 23. Initial oiling of the pivot pin surface serves to promote the flow of oil across the pin surface, thereby quickly establishing an oil path from the reservoir to the hammer hole/pin area. This oil path is established also without initial pin oiling, but a longer period of time is needed. This initial oiling of the pin surface can be provided prior to assembly by wiping the pivot pin with, preferrably, the same lubricating oil used to impregnate the sintered insert 23. Another example is illustrated in FIG. 4 of the drawings.

For example, the block 25 can be made of a sintered material and serves as the lubricant reservoir, while the slots in the insert 23 serve as the members that confine the hammers. In such a configuration, the slots in the comb block 25 are made wider than the slots in the insert to avoid contact between the lubricant reservoir and the print hammers.

Figure 4:
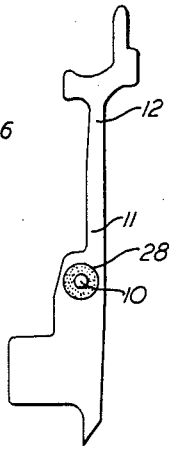
FIG. 4 is a side view in elevation to illustrate an extension of the inventive concept for use in the description to follow.

Referring now to FIG. 4 particularly, the print hammer element 11 includes a stem 12, as stated previously, supra, and the pivot pin 10 is shown with a sintered bushing 28 positioned around it. Such a bushing is dimensioned to fit around the pivot pin 10 and within a hole in the print hammer 11. The length of the sintered bushing 28, however, is limited to the width of the print hammer 11.

The sintered bushing 28 need not be formed of the same material as the sintered insert 23. Such a sintered bushing 28 increases the lubricant storage capacity of any print hammer module beyond that of the reservoir, provided by the sintered insert 23. Since the sintered bushing 28 is not in contact with the sintered insert 23, it cannot deplete the reservoir of its supply of lubricant.

In different combinations, the sintered insert 23 can be used in conjunction with pivot pins of a suitable polymer material with low frictional coefficients, or it can be used with pivot pins impregnated with a dry lubricant. In this configuration, the lubricant supplied by the sintered insert will provide prolonged operating life for the pivot pin.

Figure 5:
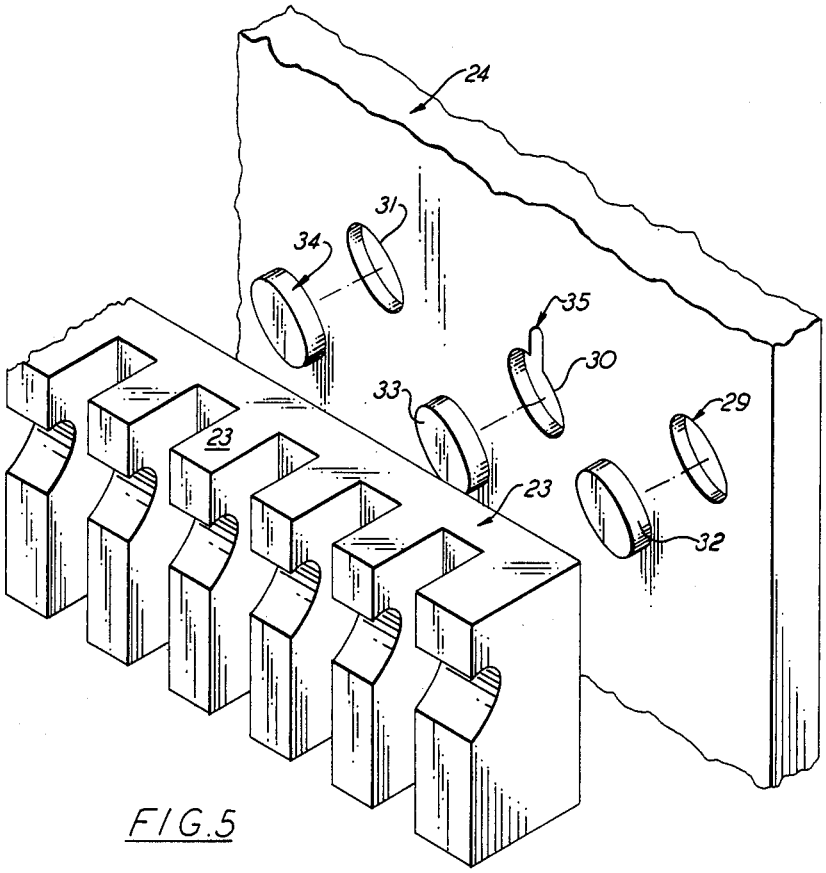
FIG. 5 is a view in perspective of a partial assembly of a structure to illustrate a further extension of the inventive concept.

FIG. 5 of the drawings illustrates another modification which increases the lubricant storage capacity for the reservoir, provided by the sintered insert 23. Having discovered that it is possible to provide extended operating life for high speed print hammers, it becomes natural to extend this life as much as possible.

All efforts to extend the operating life of high speed print hammers have centered around devising structures to increase the storage capacity of the lubricant reservoir that embody the principal features of the invention. One of the more significant of such structures is that illustrated in FIG. 5. In this view, the sintered insert 23 and the cover plate 24 are shown essentially as described, supra.

An important difference is that the cover plate 24 is formed with a plurality of recesses, three of which are identified by the reference numerals 29, 30 and 31. Each of the recesses is fitted with a porous pad, such as those identified by the numerals 32, 33 and 34, each formed of a suitable material, such as, for example, a material available commercially under the trade name Scottfelt 25, Grade 900.

These porous pads, such as the pads 32, 33 and 34, are impregnated with a suitable lubricant, which is preferably the same as or at least is compatible with the lubricant with which the sintered insert 23 is impregnated. The lubricant-impregnated pads, then, are located in their respective recesses, like the recesses 29, 30 and 31, and the cover plate 24 is positioned against the sintered insert 23, as illustrated.

Since each of the recesses in the cover plate 24 are only of limited depth, i.e., not all the way through the cover plate, the porous, lubricant-impregnated pads must be vented to avoid lubricant being forced out by changes in atmospheric pressure and/or temperature. This venting is accomplished, according to one aspect of the invention, by a careful design of each recess, i.e., so that venting can occur around the pad, or by a particular vent passage, such as a passage 35.

The pads, such as described above, function as a supplemental reservoir of lubricant, from which the main reservoir, provided by the sintered insert 23, replenishes itself as its lubricant is used. Since the lubricant impregnated pads also reduce the surface tension at the pad/sintered insert interface, lubricant in the sintered insert moves easily and readily through its pores to perform its lubricating function for the pivot pin/-hammer interface.

Figure 6:
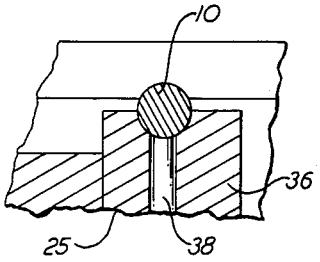
FIG. 6 is an end view of a modified construction to illustrate a still further extension of the basic inventive concept.

FIG. 6 of the drawings illustrates still another modification in order to increase the lubricant storage capacity for the reservoir, provided by the sintered insert 23. The significance of this modification will be immediately apparent when it is realized that it can be used in conjunction with the supplemental reservoir of FIG. 5, or alternatively, it can be used alone.

To explain the significance of the modification shown in FIG. 6 further, it can be used alone as the principal reservoir for the pivot pin 10, or alternatively, it can be used to supplement the supplemental reservoir of FIG. 5, if needed, to provide still more reserve capacity for the lubricant. More of the structural arrangement is visible in FIG. 7, which is a front view in elevation.

Figure 7:
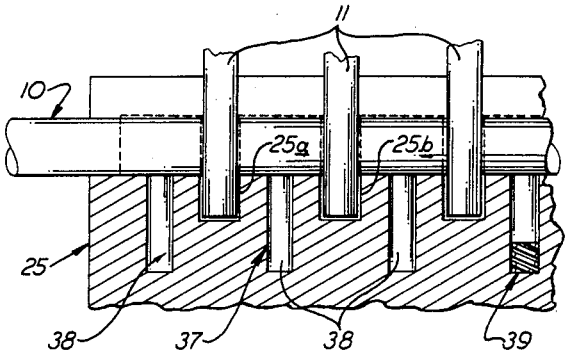
FIG. 7 is a partial front view in elevation of the modification shown in FIG. 6.

Referring now more specifically to these FIGS. 6 and 7, the print hammer pivot pin 10 is illustrated as supporting a plurality of print hammers, three of which are shown in FIG. 7 and identified by the numeral 11. Between each of the slots, such as the respective slots **25*a* and 25*b*, is a web 36 that separates adjacent print hammers. It is in this web 36 that a hole 37 is formed, and a similar hole 37 is formed in the web 36 between each of the print hammers 11 to a depth that will provide a desired lubricant reservoir capacity in the comb block 25**.

Each hole 37 is filled with a cylindrical porous polymer wick 38 formed of a suitable material, such as, for example, a 20 micron material available from Porex Technologies Corporation under a catalog identification "UHMW Z-10". Such a material is presently preferred, but any material that is desired or that is suitable, such as felt, is entirely acceptable. However, it should be a material that will function to retain the lubricant within its pores.

While a cylindrical shape is identified above, it should be understood that this is because each of the holes 37 is cylindrical. If the holes 37 are formed with another configuration, each wick 38 can have a configuration to match, or alternatively, each wick 38 can have a different and even a distinctive configuration. It is only necessary that each wick 38 be capable of retaining a supply of lubricant.

Each of the wicks 38 must be of sufficient length to ensure close contact with the pivot pin 10. Alternatively, since such a close contact with the pivot pin 10 may ultimately cause wear, or since a wick made of some materials may result in shrinkage, to cause a separation of the wick 38 from close contact with the pivot pin 10, a presently preferred structural arrangement includes a helical compression spring 39 within each hole 37 at the end of the wick 38 furthermost from the pivot pin 10 to assure that close contact between wick and pivot pin is maintained.

In operation, lubricant flows from each wick 38, along the pivot pin 10, to the pivot pin/hammer hole interface by way of capillary action. Since each wick 38 is maintained out of contact with a print hammer, there is none of the type of pumping action involved to cause a premature flow of lubricant from each wick 38.

Figure 8:
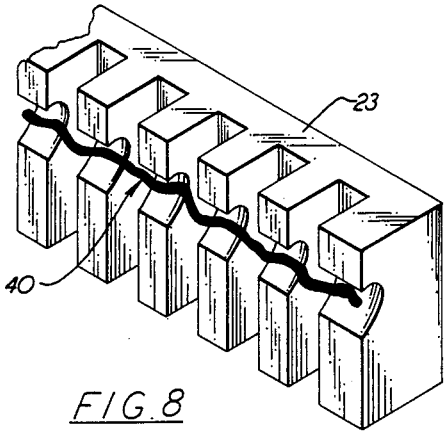
FIG. 8 is a perspective view of an insert in accordance with the invention with a bead of grease applied across the slots prior to assembly.

As has been stated previously, supra, an important purpose for the various structural arrangements described is an extension of the operating life of print hammers that move at the high speeds of todays printers. Therefore, in addition to the above-described structural improvements, a bead of grease 40, illustrated in FIG. 8 of the drawings, is applied about the pivot pin 10 adjacent the print hammer 11. The bead of grease 40 is applied to the insert 23 as illustrated in FIG. 8 when the insert alone is greased. Of course, the bead of grease 40 could be applied to the comb block 25, if desired, or to both the insert 23 and the comb block 25.

Figure 9:
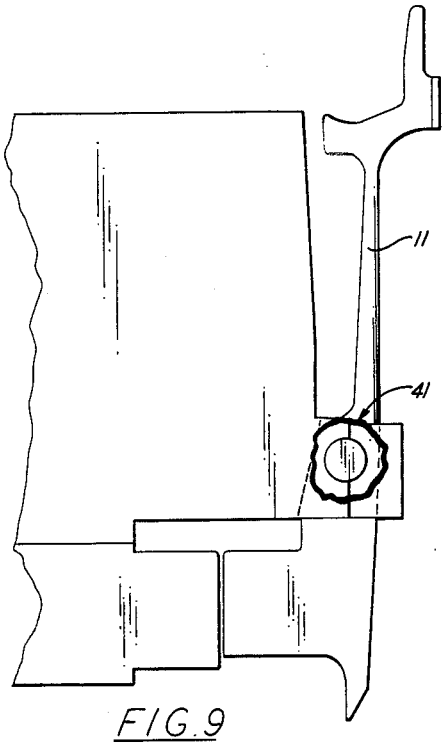
FIG. 9 is a side view in elevation of an assembled print hammer module to illustrate the greased area that results from the assembly process.

When the insert 23 is assembled to the comb block 25, the grease bead 40 is squeezed into the gaps between each hammer 11 and the adjacent side walls of the slots **23*a* and 23*b* within the insert 23 and the slots (e.g., 25*a* and 25*b*) of the comb block 25, essentially filling the area around the pivot pin 10 identified by the numeral 41 in FIG. 9. (This illustration is for the instance when a bead of grease is applied to both the insert 23 and the comb block 25** prior to assembly)

It has been found that such a bead of grease 40 in this environment functions much like a head band about the forehead of a sports participant in keeping perspiration away from the eyes. In this instance, the bead of grease 40 serves to maintain the lubricant in the desired area and away from the print hammer 11. The preferred type of grease for use in conjunction with the present invention is a clay-based grease, such as available commercially under the name "Mobilgrease 28", which is compatible with the insert lubricant identified hereinabove.

Moreover, the bead of grease 40 provides an initial lubricant and, as its own oil is depleted, receives oil from the insert 23. The bead of grease 40 acts as a transfer medium in controlling the passage of the lubricant from the reservoir, provided by the sintered insert 23, into the pivot pin/hammer hole interface with no runoff down the stem 12 of the print hammer 11. As has been described, such a runoff of the lubricant causes changes in the flight time of the print hammers, aside from the premature depletion of the lubricant from the reservoir.

The invention has been shown, described and illustrated in substantial detail, along with several modifications thereof, all with reference to presently preferred embodiments. It will be understood by those skilled in this art that the foregoing and other changes may be made without departing from the spirit and scope of the invention, which is set forth in the claims appended hereto.

What is claimed is:

1. A high speed print hammer module, comprising:

a print hammer element having a stem portion with a pivot pin to define a fulcrum located between two ends of said stem portion;

an impact mass to define a head portion located at one of said two ends of said stem portion;

an armature of an electromagnetic circuit located at the other of said two ends of said stem portion; and a lubrication system for said pivot pin, including:

block means with a slot of a predetermined width and depth to receive a part of said print hammer element, to bear against a part of said pivot pin at points on opposite sides of said print hammer element;

insert means match slot of a predetermined width and depth to receive a part of said print hammer element, to bear against a part of said pivot pin, to form a clamp with the matching parts of said block means, to hold said pivot pin firmly;

at least one of said means being formed of sintered material impregnated with lubricant; and said width and depth of said slot in said means formed of sintered material being sufficient to avoid contact with said print hammer element.

2. A high speed print hammer module as defined in claim 1 wherein both of said means include a plurality of said slots, each with said predetermined width and depth, to receive a plurality of said print hammer elements.

3. A high speed print hammer module as defined in claim 2 wherein both of said means with a plurality of slots being, respectively, comb-like members, said insert means being formed of sintered material impregnated with lubricant to form a reservoir for said lubricant that is out of contact with a print hammer element, and said pivot pin being formed of a solid, hardened material.

4. A high speed print hammer module as defined in claim 1 including a bushing formed of a sintered material impregnated with lubricant positioned about said pivot pin to function as an additional reservoir of lubricant, when used with another reservoir of pivot pin lubricant.

5. A high speed print hammer module as defined in claim 1 including a plurality of lubricant impregnated pads supported against said sintered insert to function as a supplemental reservoir of lubricant.

6. A high speed print hammer module as defined in claim 5 wherein each of said plurality of lubricant impregnated pads is supported in individual recesses formed in plate means adjacent said sintered insert.

7. A high speed print hammer module as defined in claim 6 including means to vent each of said lubricant impregnated pads in its individual recess to permit said lubricant to flow readily as needed.

8. A high speed print hammer module as defined in claim 1 including means between adjacent slots to define a hole receiving lubricant impregnated material positioned to be in contact said pivot pin to supplement said lubricant.

9. A high speed print hammer module as defined in claim 8 including spring means located within each of said holes to urge said lubricant impregnated material in contact with said pivot pin to assure said contact.

10. A high speed print hammer module as defined in claim 1 including a bead of grease, that had initially been applied prior to assembly along an axis generally parallel to said pivot pin, which after assembly is located on each side of said print hammer element within said slots between each of said print hammer elements to maintain said lubricant in a predetermined area.

11. A high speed print hammer mechanism, comprising:

a plurality of print hammer elements supported by a fixed-position pivot pin;

said pivot pin being arranged to support said plurality of print hammer elements for independent oscillatory motion over relatively small arcuate distances at high speeds;

a lubrication system for said pivot pin, including:

block means having a plurality of slots of a predetermined width and depth to receive, respectively, a part of one of said plurality of print hammer elements, to bear against a part of said pivot pin at points on opposite sides of each of said plurality of print hammer elements;

insert means having a plurality of slots of a predetermined width and depth to receive, respectively, a part of one of said plurality of print hammer elements, to bear against a part of said pivot pin, to form a clamp with the matching parts of said block means, to hold said pivot pin firmly;

at least one of said means being formed of sintered material impregnated with lubricant;

said width and depth of each of said plurality of slots in said means formed of sintered material being sufficient to avoid contact with the part of a print hammer element received therein; and a bead of grease applied, prior to assembly, along said means formed of sintered material in a direction generally parallel to said pivot pin so that, during assembly of said means, to clamp and to hold said pivot pin firmly, the bead of grease is squeezed into said slots on each side of each of said print hammer elements.

12. A high speed print hammer mechanism as defined in claim 11 including means between adjacent slots to define a hole, each hole for receiving lubricant impregnated material to supplement lubricant in said sintered material.

13. A high speed print hammer mechanism as defined in claim 12 including spring means located within each hole to urge said lubricant impregnated material into contact with said pivot pin to maintain said contact.

14. A high speed print hammer mechanism as defined in claim 13 including a plurality of lubricant impregnated pads supported against said means formed of sintered material to function as a supplemental reservoir of lubricant.

15. A high speed print hammer mechanism as defined in claim 14 wherein each of said plurality of lubricant impregnated pads is located within an individual recess formed in a plate means adjacent said means formed of sintered material.

16. A high speed print hammer mechanism as defined in claim 15 including means to vent each of said lubricant impregnated pads within its individual recess to permit said lubricant to flow readily as needed.

* * * * *

UNITED STATES PATENT AND TRADEMARK OFFICE

CERTIFICATE OF CORRECTION

PATENT NO. : 4,756,246

DATED : July 12, 1988

INVENTOR(S) : Kotasek et al.

It is certified that error appears in the above—identified patent and that said Letters Patent is hereby corrected as shown below:

Column 8, line 31, delete "match" and substitute therefor --matching said bar means with a--.

Signed and Sealed this

Twenty-eighth Day of March, 1989

*Attest:*

DONALD J. QUIGG

*Attesting Officer*

*Commissioner of Patents and Trademarks*